United States Patent [19]

Winkler

[11] 3,952,200

[45] Apr. 20, 1976

[54] X-RAY GENERATOR FOR AN APPARATUS FOR THE PRODUCTION OF TOMOGRAPHIC X-RAY PICTURES

[75] Inventor: Hans Werner Winkler, Buckenhof, Germany

[73] Assignee: Siemens Aktiengesellschaft, Erlangen, Germany

[22] Filed: Feb. 28, 1975

[21] Appl. No.: 554,215

[30] Foreign Application Priority Data

Mar. 5, 1974 Germany ..... 2410524

[52] U.S. Cl. ..... 250/402; 250/445 T

[51] Int. Cl.[2] ..... H05G 1/00

[58] Field of Search ..... 250/445 T, 401, 402, 250/408, 409, 413, 416

[56] References Cited

UNITED STATES PATENTS 3,546,462 12/1970 Cesar ..... 250/445 T

*Primary Examiner*—Craig E. Church

*Attorney, Agent, or Firm*—Haseltine, Lake & Waters

[57] ABSTRACT

An X-ray generator for an apparatus for the production of tomographic X-ray pictures at varying exposure periods, which is preset through the apparatus motion path of the exposure unit consisting of an X-ray tube and picture target carrier, and which includes setting means for adjusting the X-ray tube voltage and the X-ray tube current and a timing switch for determination of the exposure time. Programmed into the generator is a pair of values from the X-ray tube voltage and X-ray tube current for each exposure time and for each body organ which is to be X-rayed selectable by means of a selector arrangement, as well as including means for the selection of the path of motion.

5 Claims, 3 Drawing Figures

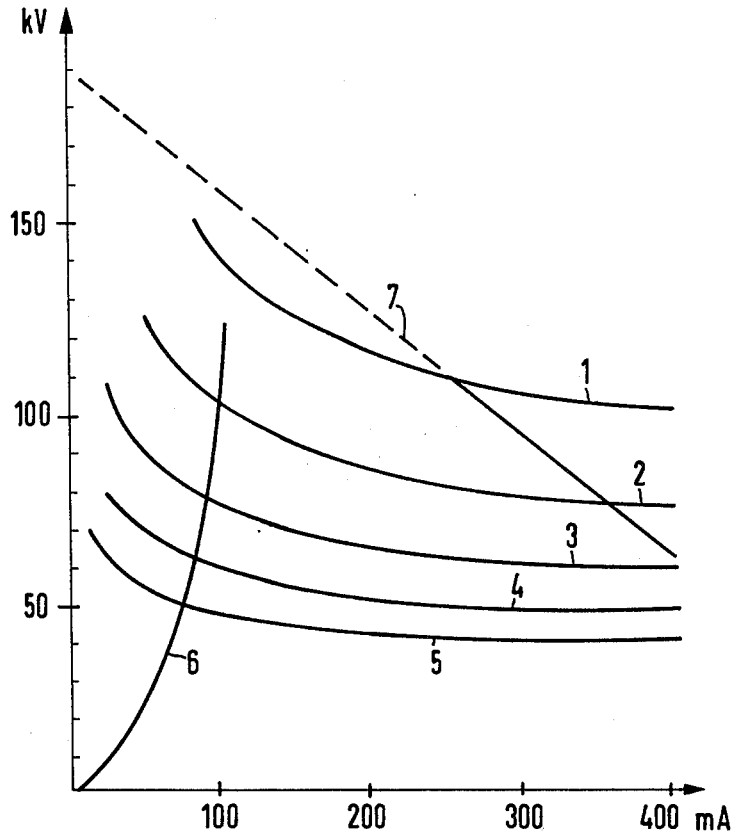
Fig. 1
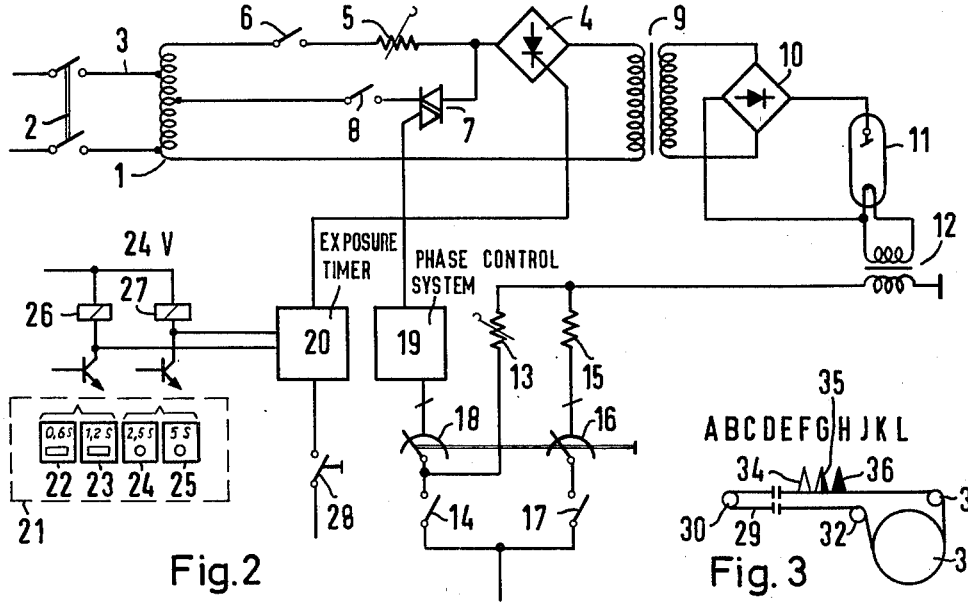
Fig. 2
Fig. 3

X-RAY GENERATOR FOR AN APPARATUS FOR THE PRODUCTION OF TOMOGRAPHIC X-RAY PICTURES

FIELD OF THE INVENTION

The present invention relates to an X-ray generator for an apparatus for the production of tomographic X-ray pictures.

An X-ray generator for an apparatus for the production of tomographic X-ray pictures at varying exposure periods, which is preset through the apparatus motion path of the exposure unit consisting of an X-ray tube and picture target carrier, and which includes setting means for adjusting the X-ray tube voltage and the X-ray tube current and a timing switch for determination of the exposure time, must render it possible to facilitate adjustment of the X-ray tube voltage and X-ray tube current for a tomographic X-ray picture when operating in the absence of an automatic exposure timer device. The exposure time or period for the production of a tomographic X-ray picture is preset through the timing mechanism of the exposure apparatus.

DISCUSSION OF THE PRIOR ART

The currently known X-ray generators for tomographic X-ray picture apparatus possess separate setting components or organs for the X-ray tube voltage and the X-ray current. In addition to the selection of the path of motion of the movably supported exposure unit, which consists of the X-ray tube and picture target carrier, for the production of a series of exposures, the X-ray tube voltage and the X-ray tube current of the X-ray apparatus must also be separately selected. Thus, prior to the production of a tomographic X-ray picture, a relatively large number of manipulations are required.

It is already known to simplify the operation of X-ray generators which are not employed for the production of tomographic X-ray pictures in that the individual body organs which are to be X-rayed have predetermined exposure data combinations fixedly associated therewith, and that for each body organ the therewith associated exposure data combination is selected by depressing a push-button. Consequently, for effecting the exposure or X-raying of a body organ, only a single push-button need be depressed. Therewith are set all of the exposure data. This concept, however, is not readily transferable to an X-ray generator for an apparatus used in the production of tomographic X-ray pictures since, for the production of tomographic X-ray pictures, the exposure time is fixedly preset and may possess different values for one and the same organ. In correspondence with these varying values, a plurality of exposure data combinations must thus be associated with an organ. The different exposure times for an organ are obtained in that a tomographic X-ray apparatus is utilizable for the production of either planigraphs or of zonographs. In a planigraph, only a relatively thin body stratum or plane is sharply imaged, whereas in a zonograph, a thicker body zone is sharply reproduced on the picture. In accordance therewith, the angle of motion of the exposure unit, and thereby the exposure time, is larger for a planigraph then for a zonograph.

SUMMARY OF THE INVENTION

Accordingly, it is an object of the present invention to provide an X-ray generator of the type as described hereinabove, whose operation is appreciably simplified in comparison with that of the state of the art.

The foregoing object is inventively attained in that there is programmed in the generator a pair of values from the X-ray tube voltage and X-ray tube current for each exposure time and for each body organ which is to be X-rayed selectable by means of a selector arrangement, as well as including means for the selection of the path of motion. In the inventive X-ray generator, there is thus required only a single adjustment for a planigraph or zonograph. In actual practice, it is sufficient when two paired values for the X-ray tube voltage and the X-ray tube current are preprogrammed for each organ, of which one pair of values is selected for a long and the other pair of values for a short exposure period.

In a suitable embodiment of the present invention, the X-ray generator incorporates a variable-ratio transformer for the X-ray tube voltage. Thus, within the range of short exposure periods, meaning at higher X-ray tube currents, the X-ray tube voltage may be set through the X-ray tube current and the voltage reduction or drop-off through a series resistance located in the power supply circuit of the X-ray tube and which, for example, may be the internal resistance of the generator. At long exposure periods and low X-ray tube currents, the setting of the X-ray tube voltage and the X-ray tube current is carried out through the phase angle while the primary voltage is transmitted to the high-voltage transformer.

BRIEF DESCRIPTION OF THE INVENTION

Reference may now be had to the following detailed description of exemplary embodiments of the invention, taken in conjunction with the accompanying drawings; in which:

FIG. 1 shows a graphical representation of the X-ray tube current plotted against the X-ray tube voltage pursuant to the present invention;

FIG. 2 illustrates a schematic block circuit diagram for an X-ray generator pursuant to the invention; and FIG. 3 is a schematic representation of a setting organ for the generator of FIG. 2.

DETAILED DESCRIPTION

Referring now in detail to the drawings, in the graph shown in FIG. 1, the X-ray tube current is represented by the abscissa, and the X-ray tube voltage by the ordinate. Curves 1 through 5 have associated therewith paired values from the X-ray tube voltage and X-ray tube current, which provide the same dosage output. At a predetermined constant exposure period, there is consequently achieved, for example, from all paired values from the X-ray voltage and the X-ray current which are ascertained from Curve 1, the identical picture blackening.

By means of a tomographic X-ray apparatus there may, in general, be selectively produced either a planigraph or a zonograph. In a planigraph, a relatively thin body layer is sharply imaged, whereas in a zonograph, a body zone or region having a relatively large thickness is sharply imaged. In accordance therewith, the angle which is covered during the exposure period by the exposure unit, which is constituted of the X-ray tube and picture target carrier, is substantially larger for a planigraph than for a zonograph. From the foregoing there may be ascertained that the exposure periods for planigraphs are larger than those for zonographs. The exposure times, in addition to the type of the exposure, also depend upon the blurred figure. Each body organ which is to be X-rayed has two exposure periods associated therewith when, for either a planigraph or zonograph, there is basically employed a predetermined tomographic figure. Detrimentally, two paired values from the X-ray tube voltage and X-ray tube current must be made available for each body organ. When a plurality of tomographic figures are available for one of the exposure types, or for both exposure types, there is an increase in the number of exposure periods and, resultingly, in the paired values for the X-ray voltage and X-ray tube current.

FIG. 1 is based on the assumption that, in conformance with the above explanations, there are available two paired values for each body organ to be X-rayed for the production of an exposure, namely, a pair of values at a low X-ray tube current for a lengthy exposure period (planigraph), and a pair of values at a high X-ray tube current for an exposure having a short exposure period (zonograph). Operating curve 6 in FIG. 1 relates to exposures with a lengthier exposure period, and operating curve 7 and for exposures with a shorter exposure period. Curve 6 is physically realizable through the provision of a phase lead control arrangement in the primary circuit of a high-voltage transformer, by means of which the phase angle is variable during connection of the supply voltage to the high-voltage transformer. In conformance with the phase angle, there are thus obtained different paired values from the X-ray tube voltage and X-ray tube current, corresponding to Curve 6.

Curve 7 is based on the fact that the high-voltage transformer is operated as in Curve 6 by a single fixed no-load voltage at its outlet, and that the X-ray tube voltage is set or adjusted through the voltage dropoff at the internal resistance of the high-voltage transformer, which is represented by a series resistance in the supply circuit of the X-ray tube, or by a special compensating or series resistance of this type. The voltage at the X-ray tube, accordingly, depends upon the X-ray tube current. Since the X-ray tube current is determined by the filament current of the X-ray tube, this results in the setting of the X-ray tube current, as well as of the X-ray tube voltage, through the filament current. The no-load voltage of the generator, predicated on Curve 7, lies at about 190 kV and drops off in accordance with Curve 7 (linear) at an increasing X-ray tube current. With each X-ray tube current, based on Curve 7, there is associated a predetermined X-ray tube voltage.

From FIG. 1 there may be ascertained that an exposure which, for example, is produced at a dosage output pursuant to Curve 2, is produced with a regulation of dosage output pursuant to Curve 6 at a X-ray tube voltage of 103 kV and an X-ray tube current of 100 mA, while for a selection of the X-ray tube voltage and the X-ray tube current pursuant to Curve 7, the X-ray tube voltage is 76 kV and the X-ray tube current is 370 mA. Both pairs of values will provide the same picture blackening or darkening within a predetermined exposure period.

From FIG. 1 there may be ascertained that the exposure data for the exposures, which are to be produced at a low X-ray tube current in the magnitude of up to about 100 mA, are set through the phase lead control arrangement, whereas the exposure data for exposures at a high X-ray tube current above 100 mA, may be selected through the filament current of the X-ray tube. A selection of lower X-ray tube currents and lower X-ray tube voltages through the filament current of the X-ray tube is only possible with difficulty since, in this case, a relatively high-ohmic series resistance must be positioned in the supply circuit of the X-ray tube, and which is undesirable. Only through the use of such a high-ohmic resistance is there possible a correspondingly steep drop off or slope of the Curve 7, and thereby, a selection of lower X-ray tube voltages at lower X-ray tube currents. The selection of higher X-ray currents is principally possible through a phase lead control arrangement, however, herein there are required switch elements which are dimensioned for a relatively high current. These switch elements are, however, quite expensive.

It may thus be ascertained that, in an X-ray generator for a tomographic X-ray apparatus, the selection of two paired values for the X-ray voltage and X-ray tube current for each organ which is to be X-rayed, thus becomes possible in a particularly simple manner when one of the paired values is determined through the filament current of the X-ray tube and the other paired values through a phase lead control arrangement located in the primary circuit of the high-voltage transformer. The phase angle hereby determines the effective value of the X-ray tube current and the X-ray tube voltage and, under circumstances, their peak value as well.

Illustrated in FIG. 2 is an X-ray generator which incorporates the relationships of FIG. 1. An input transformer 1 is connectable to the power supply circuit through a power switch 2. The tap-off 3 at the transformer is fixedly set. Two voltages are tapped off from the input transformer 1, which are, on the one hand, transmissible to a thyristor switch 4 through intermediary of a series resistance 5 and a relay contact 6 and, on the other hand, through a triac 7 and a relay contact 8. The thyristor switch 4 controls the actuation of the primary winding of the high-voltage transformer 9 at the input transformer 1. The secondary winding of the high-voltage transformer 9 is connected to an X-ray tube 11, through a high voltage rectifier 10.

The filament current of the X-ray tube 11 is generated through a filament transformer 12 which is connectable to the power supply either through a series resistance 13 and a relay contact 14, or through a series resistance 15 and a variable resistance 16, as well as a relay contact 17. The variable resistance 16 is a component of an organ selector. The organ selector further contains a variable resistance 18, which is associated with a phase control arrangement 19, and which controls the triac 7. By means of the variable resistance 18 the phase angle is adjustable while the output voltage of the input transformer 1 is transmitted to the high-voltage transformer 9.

The exposure period is determined through intermediary of a timer switch 20 which is controllable from the tomographic X-ray apparatus. The tomographic X-ray or targeting apparatus includes a control panel or console 21, on which there are located push-buttons 22 through 25, by means of which may be selected the path of motion of the exposure unit which consists of the X-ray tube and the picture target carrier, and the type of an exposure (planigraphic, zonographic). The push-buttons 22 and 23 are associated with short exposure periods of 0.6 and 1.2 seconds, and the push-buttons 24 and 25 with lengthier exposure periods of 2.5 and 5 seconds. Through push-buttons 22 and 23 there is selected a linear blur path for zonography, and through the push-buttons 24 and 25, a circular blur path for planigraphy.

Upon depression of one of the push-buttons 22 through 25, the blurring path is selected, and the exposure period is introduced into the exposure timer 20. Furthermore, upon depressing one of the push-buttons 22 and 23, there is excited the relay 26, and upon depressing one of the push buttons 24 and 25, the relay 27 is excited. The relay 26 actuates the contacts 6 and 17, and the relay 27 actuates the contacts 8 and 14. If a short exposure period is selected (zonography), then the contacts 6 and 17 are closed. Upon the actuation of the organ selectors 16, 18, the phase control arrangement 19 becomes ineffective, since the contacts 8 and 14 are opened. The organ selector is then brought into a position associated with the organ which is to be X-rayed. In this position, the variable resistance 16 adjusts the X-ray tube current through the filament current, and the X-ray tube voltage through the voltage drop-off at the series resistance pursuant to Curve 7 in FIG. 1. Upon actuation of an exposure release 28, the thyristor switch 4 is triggered. The exposure timer 20 terminates an exposure in that, after completion of the exposure period, the bias voltage is cut off at the thyristor switch 4, so as to deactivate the thyristor switch 4.

When one of the push-buttons 24 and 25 are pressed, meaning the selection of a long exposure period (planigraphic), the contacts 8 and 14 are connected thereto. The filament current of the X-ray tube, in this instance, is determined through the resistance 13. The resistance 15 and 16 are ineffective since the contact 17 is opened. The X-ray tube voltage and the X-ray tube current, in addition to being determined from the filament current, are also determined from the setting of the variable resistance 18 and thereby from the phase angle during the time the output voltage of the input transformer 1 is transmitted to the high-voltage transformer 9. Each organ which to be X-rayed has also herein again associated therewith a predetermined setting of the variable resistance 18 and thereby a predetermined pair of the X-ray tube voltage and X-ray tube current in conformance with Curve 6 in FIG. 1.

FIG. 3 shows a possible embodiment of the organ selector. The organ selector comprises a tow line 29 which is entrained over rollers 30 through 33. The rollers 30 and 31 hereby may be connected with the setting means for the resistances 16 and 18, while on the axis of the roller 33 there may be seated an adjusting element. The tow line 29 carries three markers or indicators 34 through 36. Hereby, the marker 34 is associated with a thin, the marker 35 with a medium, and the marker 36 with a heavy patient. The setting is carried out in the manner in that the roll 33 is rotated until the particular one of the markers 34 through 36 which is associated with the patient points to a predetermined location on the scale A through L. The indicators A through L have individual body organs associated therewith.

In summation, it is thus ascertained that, for the exposure or X-raying of a body organ, only a single setting or adjusting sequence is required by means of the setting components which are associated with the roll 33. The selection of the required paired values of the X-ray tube voltage and X-ray tube current conforming to the particular exposure type (planigraphic, zonographic), is automatically effected upon actuation of one of the push-buttons 22 through 25 by means of relays 26 and 27 and the contacts which are associated therewith.

While there has been shown what is considered to be the preferred embodiment of the invention, it will be obvious that modifications may be made which come within the scope of the disclosure of the specification.

What is claimed is:

1. In an X-ray generator for an apparatus for producing tomographic X-ray pictures; an exposure unit having an X-ray tube and a picture target carrier, said exposure unit having different exposure periods through the motion path of the apparatus; setting means for the X-ray tube voltage and for the X-ray tube current; and timer means for determination of the exposure time, the improvement comprising: means in said generator for programming at least one paired value from the X-ray tube voltage and X-ray tube current for each exposure period and for each body organ to be X-rayed; a selector arrangement and means for selection of the X-ray tube motion path adapted to select an applicable paired value.

2. An X-ray generator as claimed in claim 1, comprising a series resistance in the power supply circuit of said X-ray tube; a high-voltage transformer; said X-ray tube voltage being obtained from the no-load voltage of said high-voltage transformer and the voltage drop-off required by the X-ray tube current being obtained at said series resistance at exposure periods below an upper limit, said X-ray tube current being adjustable through the filament current of said X-ray tube; a switching arrangement actuatable dependent upon a selected exposure period so as to set a fixed filament current for said X-ray tube above said limit; phase control means in the primary circuit of said high-voltage transformer adapted for actuation by said switching arrangement; said selector arrangement setting the phase angle conforming to the organ being X-rayed of the primary current being transmitted to said high-voltage transformer within a half-wave.

3. An X-ray generator as claimed in claim 2, said means for selection of the X-ray tube motion path actuating said switching arrangement.

4. An X-ray generator as claimed in claim 2, said selector arrangement including adjusting means having markers thereon indicative of various patient thicknesses; an organmeasuring scale operatively associated with said markers; and control means actuatable by said adjusting means for controlling the filament current of said X-ray tube and the phase angle of said phase control means.

5. An X-ray generator as claimed in claim 4, said adjusting means comprising a tow line arrangement.

* * * * *